United States Patent [19]

Ward, Sr. et al.

[11] Patent Number: 4,596,541

[45] Date of Patent: Jun. 24, 1986

[54] SLIT-SCORE METHOD AND APPARATUS

[75] Inventors: William F. Ward, Sr., Hampstead; Raymond S. Watson, Baltimore, both of Md.

[73] Assignee: The Ward Machinery Company, Cockeysville, Md.

[21] Appl. No.: 530,627

[22] Filed: Sep. 9, 1983

[51] Int. Cl.[4] ..... B31B 1/25

[52] U.S. Cl. ..... 493/59; 493/60; 493/354; 493/396; 83/881

[58] Field of Search ..... 493/59, 60, 324, 241, 493/355, 396; 83/881, 886

[56] References Cited

U.S. PATENT DOCUMENTS

| | | | |
|---|---|---|---|
| 2,458,867 | 1/1949 | Messersmith | 493/59 |
| 3,552,244 | 1/1971 | Smith | 493/60 |
| 3,882,745 | 5/1975 | Garrett et al. | 83/311 |
| 4,183,271 | 1/1980 | Martin | 83/175 |

FOREIGN PATENT DOCUMENTS

| | | | |
|---|---|---|---|
| 1546754 | 5/1979 | United Kingdom | 83/886 |

*Primary Examiner*—Lowell A. Larson
*Assistant Examiner*—Jorji M. Griffin
*Attorney, Agent, or Firm*—Boyce C. Dent

[57] ABSTRACT

A method of slitting selected plies of multiply paperboard blanks by compressing narrow portions against an anvil surface (preferably soft) and cutting one or more plies along the compressed portions. The apparatus includes a cutting rule (straight or annular) with compression rules on each side to compress the blanks simultaneously with the cutting. The method and apparatus may be used in conjunction with conventional flat-bed or rotary diecutting.

10 Claims, 8 Drawing Figures

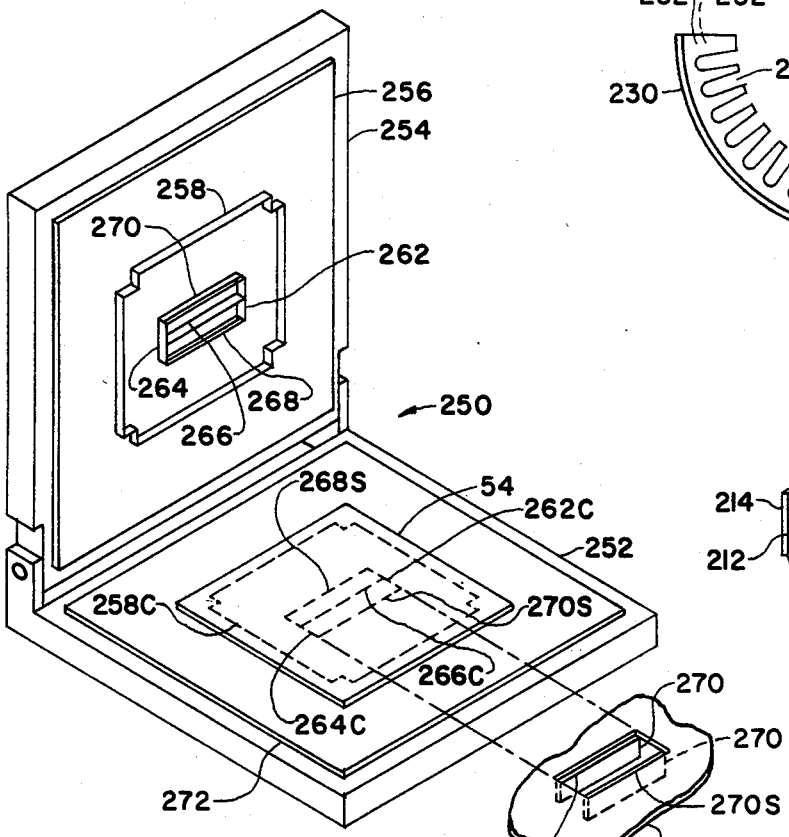
FIG. 7
FIG. 8
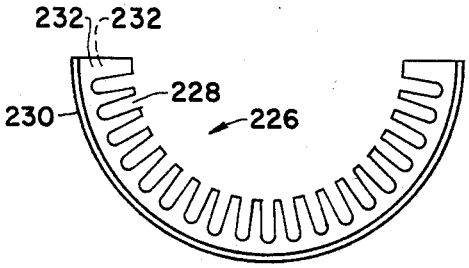
FIG. 4
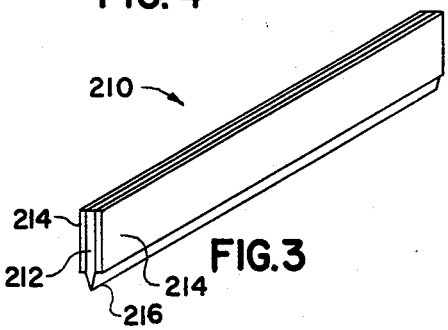
FIG. 3
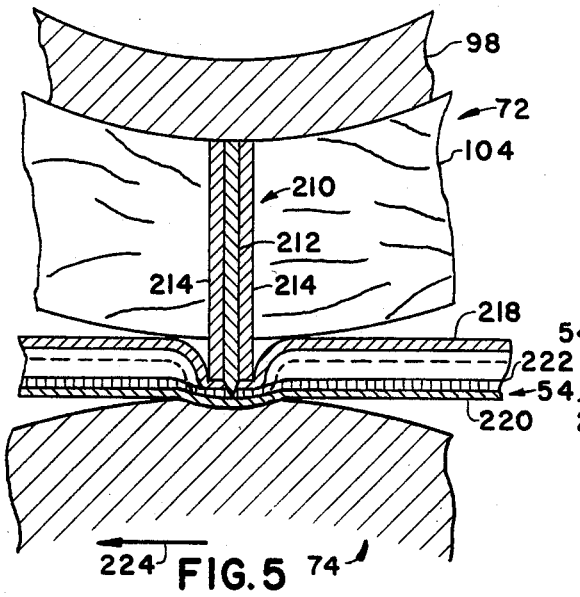
FIG. 5
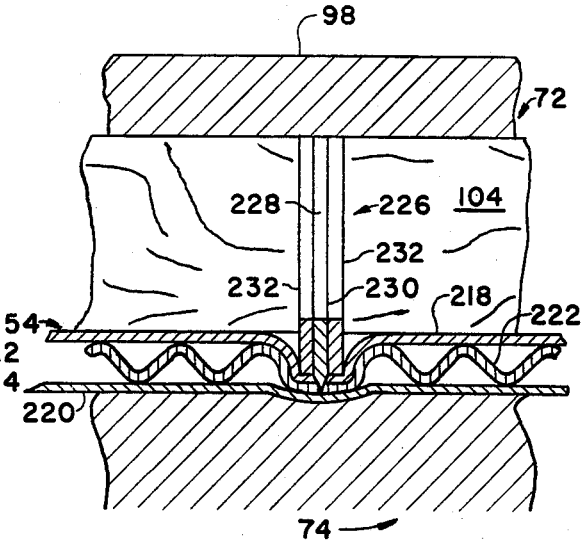
FIG. 6

SLIT-SCORE METHOD AND APPARATUS

BACKGROUND OF THE INVENTION

Die cutting machines are used to cut corrugated and solid fibre sheet stock into irregular shaped carton blanks. The sheet stock is characterized by having several plies of paper stock laminated together to form either corrugated or solid fibre sheets. The irregular shaped carton blanks are folded after die cutting to form cartons for the shipment of goods, point of sale displays, advertising displays, carton separators, and the like.

Die cut sheets are customarily scored to facilitate folding into the desired carton or other shapes. Depending on the characteristics of the stock, the sheets are sometimes difficult to fold along the scores; that is, the folds do not always follow the score lines exactly. Thus, it is often desirable to slit through several plies of the sheets, leaving one or more plies uncut. The sheets then fold very precisely along the slit.

Die cutting is accomplished either by a flat bed die cutter or by a rotary die cutter. An example of a flat bed die cutter is shown in U.S. Pat. No. 3,606,824. An example of a rotary die cutter is shown in U.S. Pat. No. 4,240,312.

Flat bed die cutters almost always cut steel-to-steel; that is, the cutting dies are straight edged rules which cut through the stock and against a steel platen. Most rotary die cutters use serrated edged rules which cut through the stock and into a soft rotating anvil although some use straight edged rules which cut against a hardened steel rotary anvil.

This invention is primarily concerned with soft anvil rotary die cutting although it may be applied to flat bed die cutters and rotary steel-to-steel (hard anvil) die cutters with equally satisfactory results.

Until now, slitting selected plies, that is, cutting part way through the stock, has been virtually impossible because the soft anvil deforms or gives beneath the slitting blade. Therefore, in effect, the thickness of the stock varies along the length of cut and uniform depths of cuts cannot be made. This occurs because the soft surface of the anvil may be irregular due to wear from previous die cutting coupled with its tendency to give beneath the cutting rule. Uniform depth's of cuts are also difficult to achieve on flat bed die cutters because the top plies of the stock sometimes tend to deform irregularly beneath the slitting rule whereas, when the stock is die cut completely through, the stock is pinched between the rule and anvil. The same is true on steel-to-steel rotary die cutters.

Accordingly, an object of this invention is to provide a method and apparatus for slitting selected plies of multiply sheets. More particulary, another object is to provide apparatus for simultaneously compressing and slitting such sheets, such compression being effective to achieve uniform depths of cuts by the slitting rules or knives. A still further object is to provide such slitting and scoring apparatus for flat bed die cutters and steel-to-steel rotary die cutters as well as soft anvil rotary die cutters.

These and other objects and novel features are generally accomplished by the invention, a summary of which appears below.

SUMMARY OF THE INVENTION

The invention includes the method of slitting selected plies of multiply paperboard stock by supporting it against an anvil surface (either flat and stationary or annular and rotating, either hard or soft), compressing narrow portions of the stock (either flat or annular compression) against the anvil surface to control the depth of cut, and cutting (either flat or annular cutting) one or more plies of the stock along the compressed portions while leaving other plies of the compressed portions uncut. The method of slitting may also be employed simultaneously in conjunction with conventional flat bed and rotary steel-to-steel or soft anvil die cutting.

The preferred apparatus for carrying out the foregoing methods includes a support means (either flat and stationary or annular and rotating, either hard or soft) against which the paperboard stock is supported during slitting of the selected plies, a compression means for compressing narrow portions of the stock against the support means, and a cutting means (either flat or annular) operating in connection with the compression means for cutting one or more plies of the stock along the narrow portions while they are compressed.

The compression means preferably comprises a narrow compression rule on each side of the cutting means which itself comprises a narrow straight-edged slitting rule. When the apparatus is applied to rotary die cutting, the diameter of the compression rules is slightly less than the diameter of the slitting rule by an amount equal to the thickness of the plies to be cut. Thus, as the paperstock passes between the rotating support means or anvil and the rotating support means for the slitting rule, the compression rules compress the paperstock against the anvil. Since the slitting rule has a greater diameter than the compression rules, its sharp edge penetrates and slits the paperstock along the narrow compressed portions of the stock. Transverse as well as annular slits may be made on rotary die cutters by mounting the slitting rules and compression rules on the support in a direction transverse to the direction of rotation of the supports. In this application, the slitting rules and compression rules are straight rather than annular; the height of the compression rules is made less than the height of the slitting rule as in the annular configuration. Diagonal slits may also be made by forming the slitting rules and compression rules in helical form so that, in effect, they wrap around the slitting rule support at the desired angle.

The apparatus may be adapted to flat bed die cutting by mounting the slitting rule and associated compressions rules on the cutting and creasing die holder along with the cutting and creasing dies. Thus, as the die holder is brought against the platen that supports the paper stock, the compression rules will compress the paper stock against the platen and the slitting rule will slit the paper stock to the desired depth along the narrow compressed portions. In this arrangement, the slitting rule and compression rules will be straight rather than annular.

The slitting rule and compression rules are preferably formed as a laminated unitary assembly as will be more particularly described hereinafter.

BRIEF DESCRIPTION OF THE DRAWINGS

In the drawings wherein like parts are marked alike:

FIG. 3 shows a transverse cut slit-score rule including the cutting rule and compression rules on both sides thereof;

FIG. 4 shows an annular cut slit-score rule including the cutting rule and compression rules on both sides thereof;

FIG. 5 is an enlarged illustration in cross section showing a transverse slit-score of a corrugated paperboard blank with a slit-score rule similar to that illustrated in FIG. 3;

FIG. 6 is an enlarged illustration in cross section showing an annular slit-score of a corrugated paperboard blank with a slit-score rule similar to that illustrated in FIG. 4;

FIG. 7 is a schematic illustration of a flat-bed type die cutter showing the slit-score rules of the present invention used in conjunction with conventional die cutting rules; and FIG. 8 shows a portion of the corrugated paperboard blank that has been die cut on the flat-bed die cutter of FIG. 7 illustrating how the blank may be folded along the slit-score lines.

DESCRIPTION OF THE PREFERRED EMBODIMENT

Figure 1:
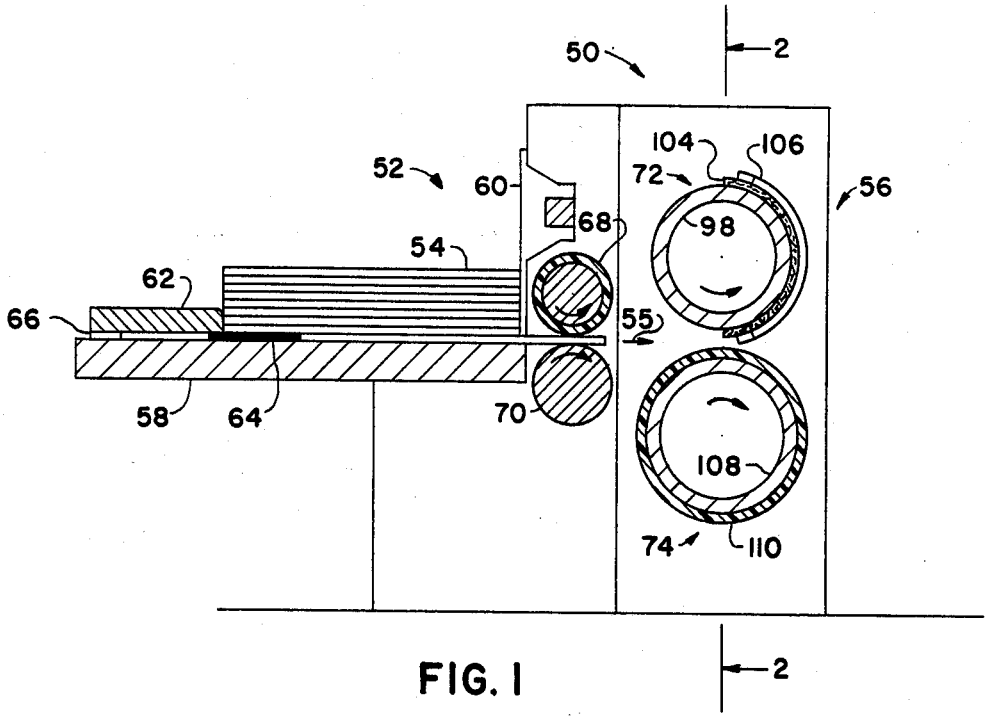
FIG. 1 is a schematic illustration in side elevation of a rotary soft anvil die cutter on which the slit-score apparatus of the present invention may be used.

The method of the present invention generally comprises the steps of supporting a multiply paperboard blank against a support surface, compressing narrow portions of the blank against the support surface, and cutting one or more plies of the blank along the compressed narrow portions while leaving other plies of the compressed narrow portions uncut.

The method is preferably carried out on a conventional soft-anvil rotary die cutter which includes a pair of rotating rolls or drums between which the paperboard blanks are advanced. A curved die board is mounted on the upper of such rolls. Conventional serrated edge die cut rules are secured to the die board and are arranged to penetrate the blanks passing between the rolls and into the resilient covering on the lower roll. The pattern of the die cut rules determines the final shape of the blank, as well as desired cut-outs therein, along with creases or scores along which the blank may be folded to form a box, display stand, or other similar item.

It is sometimes difficult to fold the blanks, particularly corrugated paperboard blanks, along the scores merely pressed in the blank by scoring rules on the die board. However, it has been found that if the blank is cut or slit part way through the thickness of the blank, it will fold precisely along the slit. But, it is difficult to slit the blank part way through because, first, the blank (especially a corrugated paperboard blank) is resilient and, second, because the surface of the lower roll is resilient so that the blank tends to deform into the low places in the covering which have been worn away by previous die cuts. The result is that it is very difficult to control the depth of the slit and thus, the slitting rule sometimes cuts completely through the blank and sometimes does not cut deep enough to provide an acceptable fold line in the blank. It is not unusual for the fold line to be cut too deep in some areas and not deep enough in others.

In accordance with this invention, compressing the areas of the blank to be slit permits the depth of the slit to be closely controlled which results in a more desirable fold line. More particularly, such compression limits the depth of penetration of the cutting edge of the slitting rule regardless of deformation of the resilent support surface or the presence of worn areas in such surface. Accordingly, the method more particularly includes the step of compressing narrow portions of the blank against a rotating resilient surface. It should also be understood that the direction of the slits can be transverse to the direction of rotation of the lower roll, in the same direction (for the sake of description, called annular herein), or diagonal to such rotation or any combination thereof. In addition, such slit-scoring is more commonly used in conjunction with conventional die cutting rules so that the desired folding lines are formed at the same time as the blank is die cut thereby eliminating the need for an additional operation. And, not all the score lines in the blank will necessarily be slit; it may be preferable to have some scores made in the conventional manner, depending on the final configuration of the box, display, or other item to be made.

The method may also be carried out on a conventional flat-bed die cutter. In essence, such die cutter has a platen (equivalent to the lower roll or lower anvil of a rotary die cutter) upon which the blank to be die cut is placed either manually or automatically. It also has a cutting die, usually above the platen, consisting of a support frame or plate for a flat die board upon which straight-edged cutting rules are mounted. The die board is brought to bear against the platen and the cutting rules penetrate the blank and stop against the platen which usually has a hardened rigid surface, such being called steel-to-steel die cutting and which may also be carried out on a rotary die cutters having a hardened lower roll. The flat bed die cutter may also be fitted with a resilient platen against which serrated die cutting rules on the cutting die may be pressed in a manner similar to a soft-anvil rotary die cutter.

The method of the invention may be carried out on a flat-bed die cutter regardless of whether a rigid or resilient platen is used. In either instance, narrow portions of the blank are compressed in the areas where slits are to be cut at less than the full thickness of the blank.

The method of the invention may also be carried out on a steel-to-steel rotary die cutter. Again, narrow portions of the blank are compressed in the areas where slits are to be cut at less than the full thickness of the blank.

Figure 2:
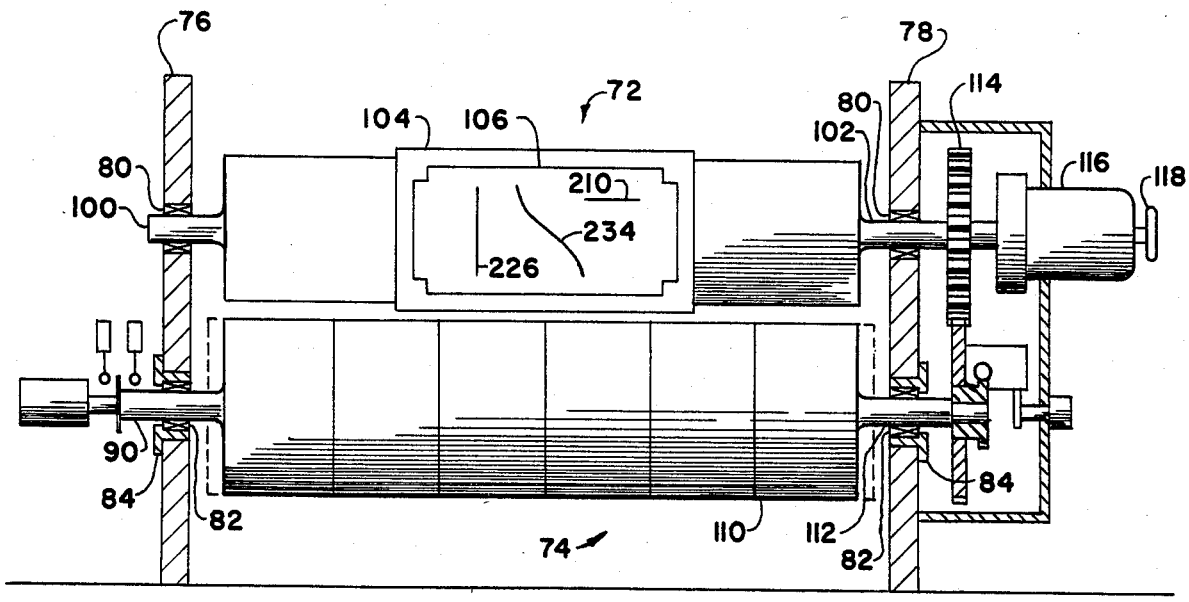
FIG. 2 is a front elevation in partial cross section of the apparatus of FIG. 1 taken along line 2—2 in FIG. 1.

The apparatus of the invention is preferably used on a soft-anvil rotary die cutter such as schematically illustrated in FIGS. 1 and 2. Referring now to FIG. 1, a rotary die cutter machine generally denoted by numeral 50 includes a feed section 52 for feeding sheets 54 into a rotary die cutter section 56. The feed section 52 and die cutter section 56 are conventional.

The feed section 52 includes a feed table 58 upon which stacks of sheets 54 are placed. The leading edges of the sheets rest against a gate assembly 60 and the trailing edges are abutted by a backstop bar 62 spanning most of the width of the machine. A feeder bar 64 is made to reciprocate along the top surface of the table 58 from beneath the backstop bar 62 which is spaced above the table 58 by a support 66. As the feeder bar 64 moves forward, its leading edge engages the trailing edge of a sheet 54 and pushes it forward in the direction of arrow 55 until the leading edge of the sheet is engaged by a pair of feed rolls 68 and 70 which advance the sheets serially into the die cutting section 56. A suitable feed mechanism is shown and described in Henry D. Ward, Jr. U.S. Pat. No. 3,588,095.

The die cutting section 56 includes an upper die holder roll assembly 72 and a lower anvil roll assembly 74 supported for rotation between a pair of laterally spaced side frames 76 and 78 (See FIG. 2). The upper roll is supported in bearings 80 in the side frames and the lower roll 74 is supported in bearings 82 in conventional eccentric housings 84 in the side frames. The eccentric housings are linked together by a cross shaft (not shown) which, when selectively rotated, rotates the eccentric housings to move the lower roll 74 closer to or farther away from the upper roll 72 to adjust the depth of penetration of die cutting rules (to be described) into a resilient cover on the lower roll.

The lower roll 72 is made to reciprocate laterally across the width of the machine as denoted by the dashed lines adjacent the end of the roll 74 in FIG. 2. This may be accomplished by use of apparatus shown and described in Ward U.S. Pat. No. 3,272,047.

The upper roll assembly 72 is conventionally constructed from a metal tube 98 having journal ends 100 and 102. The tube portion 98 has a plurality of tapped holes therein (not shwon) so that an arcuate plywood die board 104 may be bolted thereto. Die cutting rules and scoring rules 106 are secured to the die board in the conventional manner. The cutting rules are preferably serrated along their cutting edges, as is well understood by those skilled in the art, and are formed in a pattern desired for cutting the sheets 54 to such pattern as the sheets pass between the rolls 72 and 74. An example of the construction and mounting of such rules is shown and described in Martin U.S. Pat. No. 3,170,358.

The lower anvil roll assembly 74 is conventionally constructed from a metal tube 108 on which is secured an anvil cover 110 which may comprise a plurality of the individual segments as shown in FIG. 2. This permits the individual segments to be relocated on the tube 108. It should be understood that most sheets 54 are narrower than the machine so that most of the die cutting occurs near the center. Thus, as the center segments wear, they may be moved to the ends of the roll and the less worn segments on the ends placed in the center. The cover segments 110 may be secured to the tube 108 as shown and described in Charles E. Smith U.S. Pat. No. 3,602,970. The roll assembly 75 also includes journal ends 90 and 112 for supporting the roll in bearings 82 to permit rotation and reciprocation of the roll.

As best shown in FIG. 2, the journal 102 of die holder roll 72 includes a spur tooth gear 114 mounted thereon; such gear may be driven from gears on the pull rolls 68 and 70 through an idler gear (not shown). The pull rolls may be driven by an electric motor, also not shown. A conventional electric running register 116 may also be connected to the journal 102 to rotate the roll 72 relative to the gear train to place the cutting rules 106 in register with the sheets 54 passing between the rolls 72 and 74; such register may include an end adjustment handwheel which may be turned to move the roll 72 laterally for similar registration purposes. The construction and operation of the register 116 and end adjustment 118 are well known and understood by those skilled in the art.

In accordance with this invention, the blanks 54 are slit part way through by a slit-score rule generally denoted by numeral 210 in FIG. 3. Slit score rule 210 includes a straight edged cutting rule 212 (as opposed to a conventional serrated-edged cutting rule used for die cutting) and a compression rule 214 on both sides of the cutting rule 212. As shown in FIG. 3, the cutting rule has a beveled cutting edge 216 that extends below the bottom edges of the compression rules 214.

The slit-score rule 210 is used for transverse slits in blanks 54 such as illustrated in the enlarged view of FIG. 5. In this view, the blank 54 is shown in cross-section, such blank including a top liner 218, a bottom liner 220, and a conventional corrugated inner medium 222. The blank 54 moves in the direction of arrow 224; likewise, the upper roll 72 rotates in the same direction. The flutes of the corrugated medium 222 are seen from the side (rather than head on as is in FIG. 6). The compression rules 214 compress narrow areas of the upper liner 218 and corrugated medium 222 against the bottom liner 220 alongside the cutting rule 212. It can be seen in FIG. 5 that since the blank 54 is supported against the surface of the lower roll 74, the cutting rule 212 will slit precisely through the thickness of the compressed upper liner 218 and inner corrugated medium 222 but will not slit the lower liner 220. The height of compression rules 214 from their top edge (as viewed in FIG. 3) is less than the height of the cutting rules 212 by an amount equal to the combined thickness of the plies 218 and 222 to be cut (see FIG. 5); that is, the cutting edge 216 of cutting rule 212 extends below the bottom edge of the compression rules 214 amount equal to the thickness of the plies 218 and 222. Thus, it can be seen that no matter how far the paper stock is pushed, by the compression rules 214, into the resilient covering 110 of the lower roll 74 (thereby deforming the covering as shown exaggerated in FIG. 5 and 6), the cutting edge 26 can cut only the two plies of paper stock. This permits the paperstock to be pushed into the resilient covering 110 an amount sufficient to compensate for any irregularities, such as worn spots, in the covering. It also permits the lower roll 74 to be moved closer to the upper roll 72 to provide a better grip on the blanks 54 without affecting the depth of the slit or cut to be made in the blank. This would not be possible without the compression exerted by the compression rules 214. It should also be understood that if a different number of plies is to be cut (one, for example), then the slit-score rule 210 is made such that the cutting edge 216 extends beyond the bottom of the compression rules 214 an amount equal to the thickness to be cut. This holds true for annular and diagonal slitscore rules (to be described) as well as for the straight rules 210. The compression and cutting operates in the same fashion against hard anvils even though the hard anvil does not deform beneath the compression rules as does a soft anvil.

The straight slit-score rule 210 is used for cutting transverse slits in blank 54, that is, to cut slits transverse to the direction of travel of the blank between the rolls 72 and 74. When it is desired to cut slits in the same direction as the travel of the blank, a slitscore rule is 226 is used such as shown in FIG. 4. For purposes of this description, such slitting will called annular slitting. Slitscore rule 226 is similar to straight rule 210 except that it is annular so as to fit around the curved die board 104 and includes notches 228 so that the rule can be bent from a straight rule into an annular shape as shown. Conventional serrated-edge die cut rules are made in this manner as well known by those skilled in the art. Annular slit-score rule 226 includes a cutting rule 230 and a compression rule 232 on both sides thereof. Annular slit-score rule 226 is shown in FIG. 4 as being one half of a circle. This permits it to be mounted to die board 104 which is also one-half of a circle. However, another die board 104, with another rule 226 mounted thereon, may be mounted to the upper roll 72 to form a complete circle so that the blank 54 may be cut along its entire length (only one die board 104 is shown in FIG. 1). The slit-score rule 226 may, of course, be less than one-half of a circle; it can be made to any length for the desired length of an annular cut. Likewise, the length of straight rule 210 may be made of any length for the desired length of a transverse cut.

FIG. 6 illustrates the appearance of an annular cut made in the blank 54. In this instance, the cut is made between the flutes of inner medium 222 as shown although the cut may be made laterally at a point along the flutes. As in FIG. 5, the compression rules 232 compress narrow areas of the blanks so that the cutting rules 230 cuts precisely the desired depth which corresponds to the number of paper plies desired to be cut as previously explained with respect to straight slit-score rule 210.

Diagonal cuts may also be made in blank 54 by using a slit-score rule 234 (FIG. 2) which is in all respects like the annular rule 226 except that it is mounted to the die board 104 at a desired angle somewhere between a straight transverse cut and an annular cut. Thus, a diagonal cut rule would appear substantially as shown by numeral 234 in FIG. 2.

A conventional serrated-edge die cut rule is about fifteen-sixteenths of an inch in height although some rules are one inch and othes are one and one-sixteenth inches. Its thickness is usually about 0.050 inches. The rolls 72 and 74 are spaced apart such that the conventional ejection rubber (not shown) on the die board 104 on roll 72 and the resilient covering 110 on roll 74 grip the blank 54 passing therebetween to advance the blank. The height of the die cut rule is such that the roots of the serrated teeth penetrate the resilient covering 110 to assure that the blank is cut through completely.

Accordingly, the height of the slit-score rules 210, 226 and 234 is made such that the cutting edge 216 penetrates to the depth desired as previously explained. The thickness of the cutting rules 212 and 230 is less than conventional serrated-edge die cut rules, that is, preferably about 0.025 inches. The height of the compression rules 214 and compression rules 232 is preferably less than the height of the cutting rules by the thickness of two plies of paper as shown in FIG. 5 and 6. Of course, this height may be even less, resulting in a greater depth of cut, or slightly more, resulting in a lesser depth of cut. The thickness of the compression rings 214 and rings 232 is preferably less than the thickness of the cutting rules 210, 226 and 234, such thickness not being critical. If less than one-half the thickness of the cutting rules, compression of the blank will not be sufficient to control its thickness for cutting; a thickness exceeding the thickness of the cutting rules does not add to the compression necessary to achieve precise cutting of the blank.

The compression rings 214 and compression rings 232 are preferably made of metal although they may be made of other durable materials including plastic. The rings are also preferably secured to the cutting rules 212 and 230 such as by riveting or spot welding (if all the parts are metallic) or even glued to form laminated unitary slit-score rules 210, 226, and 234. A unitary assembly is easier to mount in the die board 104 than are separate pieces although separate pieces may be used. However, the slit-score rules may be manufactured from a single piece of material if desired.

Slit-scoring of the blanks is usually done in conjunction with conventional die cutting since it is easily accomplished and avoids an additional operation. Thus, the slit-score rules may be mounted to the die board 104 along with the die cutting rules 106 to both die cut and slit-score the blanks 54 as they pass between rolls 72 and 74. FIG. 2 shows a rectangular, corner-notched pattern of die cut rules 106 within which are located, merely for example, an annular slit-score rule 226, a transverse slit-score rule 210 and a diagonal slit-score rules 234.

This invention may also be applied to flat-bed die cutting if desired. A schematic illustration of a flat-bed die cutter is shown in FIG. 7.

The die cutter generally designated by numeral 250 includes a fixed platen 252 upon which the blank 54 to be die cut is placed. A die holder 254 is hinged to platen 252 so as to be pivotable to a horizontal position above the platen 252. A die board 256 is mounted to die holder 254 and the die cut rules and slit-score rules are mounted in the die board 256 in the conventional manner. For example, a rectangular, corner notched pattern of die cut rules 258, smaller in size than the blank 54 to be die cut, will cut the outline of the blank shown by dotted lines 258C. Similar die cut rules 262, 204, and 266 will cut the blank 54 along the dotted lines 262C, 264C, and 266C. And, slit-score rules 268 and 270, made in accordance with the invention (being like slit-score rule 210), will slit-score the blank 54 along lines 268S and 270S. The die cut portions 270 of blank 54 can then be folded precisely along the slit-score lines 268S and 270S as shown in FIG. 8.

The invention may also be applied to steel-to-steel rotary die cutting if desired. The arrangement would be the same as described in connection with soft anvil rotary die cutting except that the soft covering 110 on lower roll 74 would be omitted and the anvil surface of roll 74 would be made of hardened steel. Thus, the anvil surface would not deform during cutting as shown in FIGS. 5 and 6. The conventional serrated edge die cut rules 106 would be replaced with straight edge die cut rules (not shown) which would die cut against the hardened anvil. It should also be understood that the lower anvil need not extend continuously across the machine such as does roll 74. Instead, it may take the form of a conventional annular head or heads movable laterally across a support shaft so as to be positionable for operation with the slit-score rules, such as rule 226 on the upper roll 72. Similarly, the slit-score rules 210, 226, and 234 may be mounted on corresponding annular heads on an upper shaft (not shown) as well understood by those skilled in the art.

OPERATION

In operation, a conventional curved die board 104 is prepared with conventional die cut rules 106 to provide the desired shape of the final die cut blank. Slit-score rules 210, 226 and 234, are mounted in the die board 104 of such sizes and such locations to provide slits in the blank 54 along which portions of the blanks are to be precisely folded. The fully prepared die board is then secured to the roll 72 with screws (not shown) in the usual manner. The height of the slit-score rules, such as rule 210, has been determined in accordance with the blank thickness so that the cutting edge 216 of the cutting rule 212 will penetrate the blank 54 to the desired depth to cut the top plies of the blank and leave the remaining plies (usually one) uncut. As the machine is run and blanks 54 are advanced between the rolls 72 and 74, the conventional die cut rules 106 will cut the shape of the final blank and the slit-score rules 210, 226 and 234 (depending on which ones are used) will compress narrow areas of the blank and simultaneously slit the blank along the compressed areas.

If the blank is to be processed on a flat-bed die cutter, a flat die board 256 (FIG. 7) is prepared in the same manner as the curved die board 104. Die board 256 is mounted in the usual manner to the die holder 254. Blanks 54 are placed on the platen 252, either manually or automatically, and the die holder 254 is then pivoted into engagement with the platen 252. The die cut rules 258 cut the outline of blank 54 and the rules 262, 264 and 266 cut the portion of the blank to be opened as shown in FIG. 8 while slit-score rules 268 and 270 cut part way through the blank along lines 268S and 270S.

The platen 252 may be a rigid hard surface in which event the die cut rules are straight edged and cut through the blank 54 and against the surface of platen 252. However, if desired, the platen may have a layer of resilient material 272, such as urethane plastic, such as is used on the lower roll 74 of the soft anvil rotary die cutter shown in FIG. 2. In this event, the die cut rules 258 and rules 262, 264, and 266 will have conventional serrated edges such as are used on the soft anvil rotary die cutter 50. These rules penetrate through the blank and into the above-mentioned resilient layer. In either case, the compression rules 214 compress narrow areas of the blank and the slit-score rules 268 and 270 slit the selected plies of the compressed areas while leaving the remaining plies uncut.

The operation of the invention, when applied to steel-to-steel rotary die cutting, is the same in all respects as its operation when used with soft anvil rotary die cutting apparatus except that the anvil surface will not deform as previously mentioned.

Thus, the invention having been described in its best embodiment and mode of operation, that which is desired to be claimed Letters Patent is:

1. Slit-scoring apparatus for cutting selected plies of resilient multiply paperboard blanks comprising in combination:

support means for supporting said blanks during cutting thereof;

a die holder means positioned adjacent to and spaced from said support means such that said blanks are directed between said die holder means and said support means during cutting of said blanks;

compression means including a pair of rigid compression rules having a space therebetween mounted on said die holder means for compressing narrow portions of said blanks against said support means during cutting of said blanks; and cutting means including a cutting rule mounted in said space between said compression rules for cutting one or more plies of said blanks along said narrow portions during compression thereof while leaving other plies of said compressed portions uncut, said cutting rule having a cutting edge extending beyond the compression edges of said compression rules a fixed distance substantially equal to the thickness of said selected plies to be cut for controlling the depth of cut in said blanks independent of the space between said support means for said blanks and said die holder means.

2. The apparatus of claim 1 further including:

a rotatable die drum means upon which said die holder means is mounted; and said support means includes a rotatable anvil drum means adjacent said die drum means for supporting said blanks advancing between said die drum means and said anvil drum means.

3. The apparatus of claim 2 wherein said rotatable anvil drum means includes;

a resilient surface thereon for supporting said blanks during cutting thereof.

4. The apparatus of claim 2 wherein:

said cutting rule and said compression rules are straight and extend substantially transverse to the direction of rotation of said die drum means.

5. The apparatus of claim 2 wherein:

said cutting rule and said compression rules are annular and extend substantially in the direction of rotation of said die drum means.

6. The apparatus of claim 2 wherein:

said cutting rule and said compression rules are helical and extend substantially diagonal to the direction of rotation of said die drum means.

7. The apparatus of claim 2 wherein said rotatable anvil drum means includes:

a hardened surface thereon for supporting said blanks during cutting thereof.

8. The apparatus of claim 1 further including:

a flat die holder means upon which said compression means and said cutting means are mounted;

said support means including a flat platen means against which said die holder means is movable for supporting said blanks;

said compression means comprising at least one compression rule mounted on said die holder means; and said cutting means comprising at least one straight-edged cutting rule mounted on said die holder means.

9. The apparatus of claim 8 wherein said flat platen means includes one of:

a hardened surface thereon; and a resilient surface thereon, for supporting said blanks during cutting thereof.

10. The apparatus of claim 9 wherein:

said compression means includes a compression rule mounted on each side of and adjacent to each of said cutting rules.

* * * * *